United States Patent [19]

Furukawa et al.

[11] Patent Number: 4,614,551

[45] Date of Patent: Sep. 30, 1986

[54] PROCESS FOR PRODUCING LOW YIELD RATIO, HIGH STRENGTH TWO-PHASE STEEL SHEET HAVING EXCELLENT ARTIFICIAL AGEING PROPERTY AFTER WORKING

[75] Inventors: Takashi Furukawa; Michio Endo, both of Tokyo; Nagayasu Takemoto, Aichi; Kunio Watanabe, Osaka, all of Japan

[73] Assignee: Nippon Steel Corporation, Tokyo, Japan

[21] Appl. No.: 740,352

[22] Filed: Jun. 3, 1985

[30] Foreign Application Priority Data

Jan. 12, 1979 [JP] Japan ..... 54-1229
Aug. 15, 1979 [JP] Japan ..... 54-103175

[51] Int. Cl.[4] ..... C21D 7/14

[52] U.S. Cl. ..... 148/12 F; 148/12.4; 148/12.3

[58] Field of Search ..... 148/12 F, 12 C, 12.3, 148/12.4

[56] References Cited

U.S. PATENT DOCUMENTS

| | | | |
|---|---|---|---|
| 4,026,729 | 5/1977 | Nakaoka et al. | 148/12 C |
| 4,062,700 | 12/1977 | Hayami et al. | 148/12 F |
| 4,113,523 | 9/1978 | Uchida et al. | 148/12.4 |
| 4,137,104 | 1/1979 | Nashiwa et al. | 148/12 F |
| 4,188,241 | 2/1980 | Watanabe et al. | 148/12 F |
| 4,222,796 | 9/1980 | Davies | 148/12.4 |

FOREIGN PATENT DOCUMENTS

| | | | |
|---|---|---|---|
| 2239527 | 2/1975 | France | 148/12.4 |
| 16421 | 2/1977 | Japan | 148/12.4 |
| 1084231 | 9/1967 | United Kingdom | 148/12.4 |

OTHER PUBLICATIONS

Nakaoka et al; *Formable HSLA and Dual Phase Steels;* "Strength, Ductility, and Aging Properties of Continuously-Annealed Dual-Phase High-Strength Sheet Steels; TMS-AIME, 1979, pp. 126-141.

Stevenson; *Formable HSLA and Dual Phase Steels;* "*Crack Initiation and Propagation in Thermal Mechanically Treated Sheet Steels*"; *TMS-AIME, 1979, pp. 126-141.*

*Primary Examiner*—Wayland Stallard

*Attorney, Agent, or Firm*—Toren, McGeady, Stanger, Goldberg & Kiel

[57] ABSTRACT

A process for producing a low yield ratio, high strength two-phase steel sheet comprising hot rolling a steel composition containing 0.03 to 0.13% C, 0.8 to 1.7% Mn, not more than 0.1% Al, not more than 2.0% Si and not more than 0.5% Cr with a finishing temperature ranging from 750° C. to 890° C., rapidly cooling the strip to a temperature not higher than 230° C., and coiling the strip at a temperature not higher than 230° C. with the temperature variation during the period between the start and end of the coiling being no more than 100 degrees C. The Si content is limited to 1% or less for applications where paintability is of primary importance, and is limited to a range of from 1 to 2% for applications where the ductility is of primary importance. The process effects improvements in the artificial ageing property after working which improvement is uniform throughout the whole length of a coiled strip. The product obtained by the process is also described.

16 Claims, 11 Drawing Figures

COILING CONDITIONS

| | YIELD RATIO EXAMPLE 2 | YIELD RATIO EXAMPLE 4 | ARTIFICIAL AGING PROPERTY AFTER WORKING EXAMPLE 2 (Kg/mm²) | ARTIFICIAL AGING PROPERTY AFTER WORKING EXAMPLE 4 (Kg/mm²) |
|---|---|---|---|---|
| ① | 0.69 | 0.70 | 3.2 | 2.8 |
| ② | 0.56 | 0.54 | 7.2 | 8.1 |
| ③ | 0.57 | 0.56 | 7.0 | 8.0 |
| ④ | 0.76 | 0.78 | 2.4 | 3.9 |
| ⑤ | 0.52 | 0.53 | 7.6 | 8.3 |
| ⑥ | 0.53 | 0.54 | 7.6 | 8.4 |

PROCESS FOR PRODUCING LOW YIELD RATIO, HIGH STRENGTH TWO-PHASE STEEL SHEET HAVING EXCELLENT ARTIFICIAL AGEING PROPERTY AFTER WORKING

BACKGROUND OF THE INVENTION

1. Field of the Invention

The present invention relates to a process for producing a low yield ratio and high strength hot rolled steel sheet which has a two-phase structure as hot rolled and shows excellent artificial ageing property after working.

2. Description of the Prior Art

The "two-phase structure" as herein used means a structure which is composed mainly of a ferrite phase, a martensite phase and a small amount of retained austenite phase. The term "low yield ratio" means that the ratio of yield strength/tensile strength as hot rolled and coiled is not higher than 0.6, and the term "high structure" means that the tensile strength is not less than about 40 kg/mm$^2$. The term "artificial ageing property after working" means the increase of yield strength, which is caused by heating in a temperature range of from about 170° C. to 200° C. after the steel sheet has been placed under a working strain. "An excellent artificial ageing property" indicates that the amount of such increase is large and there is little variation in this property throughout the whole length of the coiled strip sheet.

Recently, in the automobile industry, much effort has been made in reducing the weight of car bodies mainly for the prupose of lowering the fuel consumption rate. Since weight reduction necessitates a thickness reduction of the steel sheet materials, it is essential to use high strength steel sheets.

However, conventionally available high strength steel sheets generally show an excessively high yield ratio so that they exhibit a "spring-back" phenomenon during their press-forming operation. Also, they exhibit poor work-hardening properties during their working so that they are readily susceptible to concentrated local strains and as a result are likely to crack during their deformation working. For all these reasons, the development of wider applications of conventional high strength steel sheets has confronted great difficulties in spite of general recognition of the need for such a product.

Because of this situation, the general tendency among users of steel sheets has been an increasing demand for the development of steel sheets with a yield ratio not higher than about 0.6 and a tensile strength not lower than 40 kg/mm$^2$, thus satisfying the low yield ratio property (namely a high degree of work-hardening property). Also, it has been desired that these high strength steel sheets exhibit a further increase in the yield strength of the finally formed product through an artificial ageing, such as that caused by passing through a coating-and-drying line (170° C.–200° C.), although such materials possess a fairly high as-formed yield strength because of their high work-hardening property.

A known method for the economical production of a low yield ratio, high strength hot rolled steel sheet, developed by one of the present inventors comprises rapidly cooling a low-carbon steel to a temperature not higher than 350° C. after a finishing hot rolling in the ferrite-austenite two-phase zone (Japanese Patent Application Laid Open No. Sho 51-79628), and a method comprising subjecting a Cr-containing steel to finishing hot rolling in the two-phase zone and coiling at a temperature not higher than 500° C. (Japanese Patent Application No. Sho 53-39163, corresponding to U.S. patent application Ser. No. 22500 of Mar. 21, 1979, incorporated herein by reference). With these methods, it has been possible to economically produce a low yield ratio, high strength, hot rolled steel sheet with less of the spring-back phenomenon during the press forming and possessing a high work-hardening property.

However, the following problems are still to be solved. The steel sheets produced by the above methods do not always possess a satisfactory artificial ageing property after the press forming, and great irregularity of this property is seen throughout the whole length of the coiled strip sheet. For example, when an artificial ageing at 180° C. for 30 minutes is given after a 3% tension deformation, the increase in yield stength is only about 3 to 4 kg/mm$^2$, or sometimes as low as 1 to 2 kg/mm$^2$ at local portions of the coil, excluding the work-hardening effect by the tension deformation.

SUMMARY OF THE INVENTION

We have discovered, as a first object, a method for producing a low yield ratio, high strength two-phase steel sheet which provides improvements in the artificial ageing property and also overcomes the problem of variation of the artificial ageing property throughout the entire length of the coiled strip sheet.

We have further discovered, as a second object, a method for producing a two-phase steel sheet having a low yield ratio, high strength, and, in addition to the improved artificial ageing property, excellent ductility. Thus, such sheets are suited for applications where ductility of the steel sheet is very important.

With respect to the first object, the method of the present invention comprises:

hot rolling a steel composition containing 0.03 to 0.13 wt.% C, 0.8 to 1.7 wt.% Mn, not more than 0.1 wt.% Al, with the balance being Fe and unavoidable impurities with a finishing temperature ranging from 750° C. to 860° C.; rapidly cooling the hot rolled steel to a temperature not higher than 230° C. with an average cooling rate ranging from 30° C./second to not larger than 500° C./second; and coiling the strip thus cooled at a temperature not higher than 230° C. with a temperature variation during a period from the start to the end of the coiling being controlled within a range of not more than 100 degrees C.

With respect to the second object, the method of the present invention comprises:

hot rolling a steel composition containing 0.03 to 0.13 wt.% C, 0.8 to 1.7 wt.% Mn, not more than 0.1 wt.% Al, and 1 to 2.0 wt.% Si, with the balance being Fe and unavoidable impurities with a finishing temperature ranging from 780° C. to 890° C.;

rapidly cooling the hot rolled steel to a temperature not higher than 230° C. with an average cooling rate ranging from 30° C./second to not more than 500° C./second; and coiling the strip thus cooled at a temperature not higher than 230° C. with a temperature variation during a period from the start to the end of the coiling being controlled within a range of not more than 100 degrees C.

The steel in accordance with the present invention contains from about 5 to 40% by volume martensite plus retained austenite and about 95 to 60% by volume ferrite.

The steel has the following properties:

| | |
|---|---|
| low yield ratio (YS/TS) | no more than about 0.7; |
| strength (kg/mm$^2$) | about 45 to 100; |
| ductility (TS in kg/mm$^2$ × E 1%) | no less than 1500; |
| artificial aging (increment in yield strength) | not less than 5 kg/mm$^2$; |
| variation of increments along length of coil | 5 to 9 kg/mm$^2$. |

DESCRIPTION OF THE PREFERRED EMBODIMENT

The technical concepts and reasons for various limitations in the method according to the present invention for achieving the first object as mentioned hereinbefore are as follows:

According to the present invention, the finishing temperature of hot rolling is lower than that ordinarily employed in order to maintain the steel in the ferrite ($\alpha$) and austenite ($\gamma$) two-phase zone and to obtain a structure mixed with fine proeutectoid ferrite ($\alpha$) and non-transformed austenite ($\gamma$). This structure is rapidly cooled to transform the non-transformed austenite ($\gamma$) into martensite ($\alpha'$) with a small amount of retained austenite.

C and Mn are essential elements for producing the above two-phase structure. With carbon contents less than 0.03%, and manganese contents less than 0.8%, it is impossible to obtain the desired two-phase structure and the resultant tensile strength is also unsatisfactory. On the other hand, with carbon contents beyond 0.13% and manganese contents beyond 1.7%, the $Ar_3$ temperature is markedly lowered. Consequently, the finishing temperature of hot rolling for obtaining a structure containing a sufficient amount of proeutectoid ferrite ($\alpha$) is lowered remarkably, resulting in a largely unrecovered structure of deformed ferrite grains, and thus degrading the ductility. Therefore, in the present invention, the carbon content is limited to the range from 0.03% to 0.13% and the manganese content is limited to the range from 0.8 to 1.7%.

Both silicon and chromium are very effective in enlarging the optimum finishing temperature range of the hot rolling which produces the desired two-phase structure and lowers the yield ratio. Therefore, the presence of these elements is very favorable in the production processes because they can moderate the severe temperature control that might be required under hot rolling conditions. For this reason, they are optional additions to the process. However, silicon contents of more than 1% will cause increased difficulty in the descaling problems after hot rolling and some deterioration of the paintability of the final products. Consequently, for applications where the paintability is of primary importance, the silicon content should be limited to 1% or less.

Figure 1:
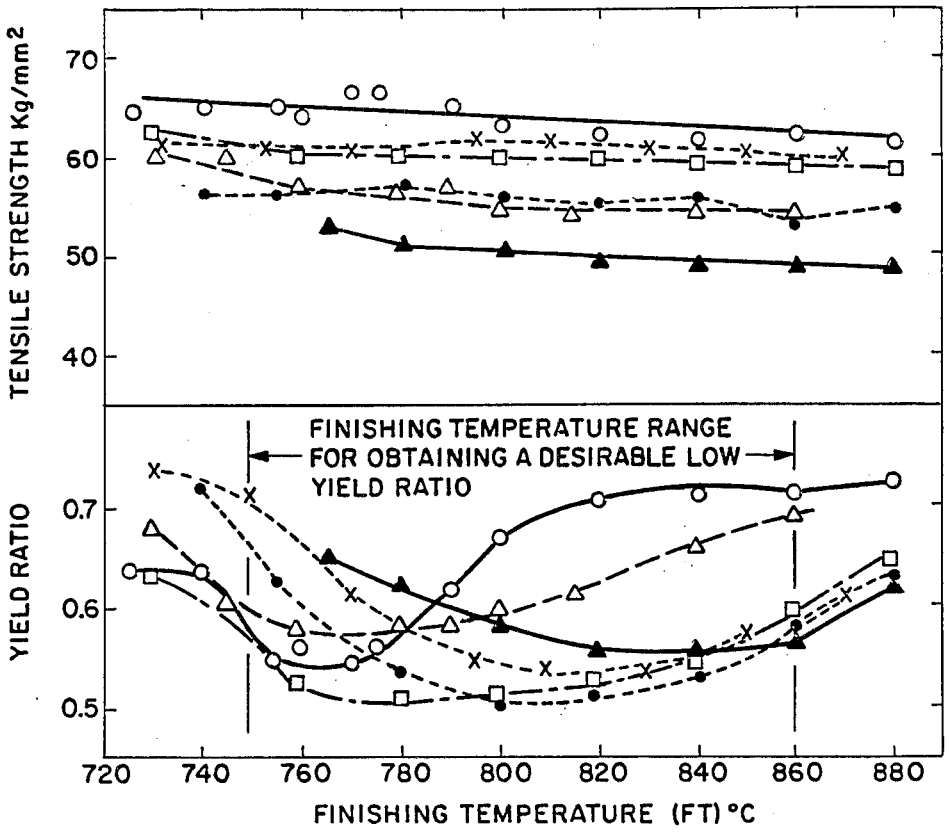
FIG. 1 is a graph showing the temperature ranges of finishing hot rolling for obtaining desirable low yield ratios in various steel compositions and the variation in tensile strength with finishing temperature.

Chromium, when added in a very small amount, is effective to increase the optimum finishing temperature range of the hot rolling, but when added together with manganese in an amount corresponding to $Mn\% + Cr\% \geqq 1.7\%$, it produces an adverse effect which narrows the optimum finishing temperature range. The most desirable effect of the chromium content is produced when the total amount of chromium and manganese is in the range of from about 1.3 to 1.5% ($Mn\% + Cr\% = 1.3$ to 1.5%). Therefore, in view of the manganese content defined above, the chromium content is limited to 0.5% or less. The effects of the Mn, Cr and Si contents on the tensile strength and the yield ratio at different finishing temperatures after cooling are shown in FIG. 1. FIG. 1 shows the finishing temperature ranges suitable for the steel compositions according to the present invention shown in Table 1 (initial thickness: 30 mm, heating at 1150° C., hot rolling with four passes to 3 mm thickness with the indicated finishing temperatures; cooling at 50° C./second and coiling at 100° C.).

As shown in FIG. 1, the finishing temperature range for obtaining the desirable low yield ratio is limited to a range of from 750° C. to 80° C. Aluminum, which is an essential element for deoxidation of the steel, should be limited to 0.1% or less. Otherwise the ductility is likely to be degraded due to increased alumina inclusions.

TABLE 1

| | C % | Si % | Mn % | P % | S % | Cr % | Al % |
|---|---|---|---|---|---|---|---|
| ○ | 0.065 | 0.01 | 1.39 | 0.007 | 0.005 | 0.30 | 0.035 |
| □ | 0.062 | 0.02 | 1.42 | 0.006 | 0.006 | 0.11 | 0.028 |
| △ | 0.060 | 0.02 | 1.41 | 0.005 | 0.006 | — | 0.025 |
| • | 0.063 | 0.01 | 1.03 | 0.008 | 0.005 | 0.31 | 0.034 |
| ▲ | 0.068 | 0.01 | 0.84 | 0.010 | 0.005 | 0.32 | 0.030 |
| x | 0.051 | 0.74 | 1.28 | 0.012 | 0.004 | — | 0.020 |

Nominal Composition

| | | | |
|---|---|---|---|
| ○ | 0.07 C | 1.4 Mn | 0.3 Cr |
| □ | 0.06 C | 1.4 Mn | 0.1 Cr |
| △ | 0.06 C | 1.4 Mn | |
| • | 0.06 C | 1 Mn | 0.3 Cr |
| ▲ | 0.07 C | 0.8 Mn | 0.3 Cr |
| x | 0.05 C | 0.7 Si | 1.3 Mn |

After the completion of the hot rolling, the steel strip is rapidly cooled to transform the non-transformed austenite (γ) coexisting with the proeutectoid ferrite (α) into the martensite (α'), leaving a small amount of retained austenite. If the cooling rate is less than 30° C./second, the non-transformed austenite (γ) tends to transform into pearlite, thus markedly reducing the possibility of transformation into the martensite (α') with a small amount of retained austenite. On the other hand, when the cooling rate is higher than 500° C./second, the resultant ductility is lowered because there is not ample time for the diffusion of the solute carbon in the proeutectoid ferrite into the non-transformed austenite, nor for the recovery of the worked structure in the proeutectoid ferrite (α) by the finishing rolling (particularly when the finishing temperature is relatively low in the desirable range).

Accordingly, the cooling rate is limited to the range of from 30° C./second to 500° C./second. The reason for limiting the coiling temperature to 230° C. or lower is that when the steel strip is coiled at a temperature higher than 230° C., the proportion of the non-transformed austenite (γ) which is transformed into the bainite increases and thus the tendency of transformation into the martensite (α') with a small amount of retained austenite is reduced. This results in failure to obtain the desired low yield ratio.

The foregoing is a description of the general and basic aspects of the techniques for producing a low yield ratio, high strength two-phase steel sheet. For remarkable improvement of the artificial ageing property of the steel sheet after working, the following conditions must be satisfied. Namely, the variation in the coiling temperature must be within the range of not larger than 100 degrees C, and the upper limit of the coiling temperature must be adjusted so as not to exceed 230° C. From the viewpoint of attaining the martensitic transformation, there is no lower limit on the coiling temperature in practice.

The technical concepts and reasons for various limitations in the method according to the present invention for achieving the second object as mentioned above are as follows:

The present inventors have studied the steel sheet which can be obtained by the above described method, and particularly the resultant ductility. The inventors have found that the silicon content plays an important role in effecting substantial improvements in the ductility.

Figure 2:
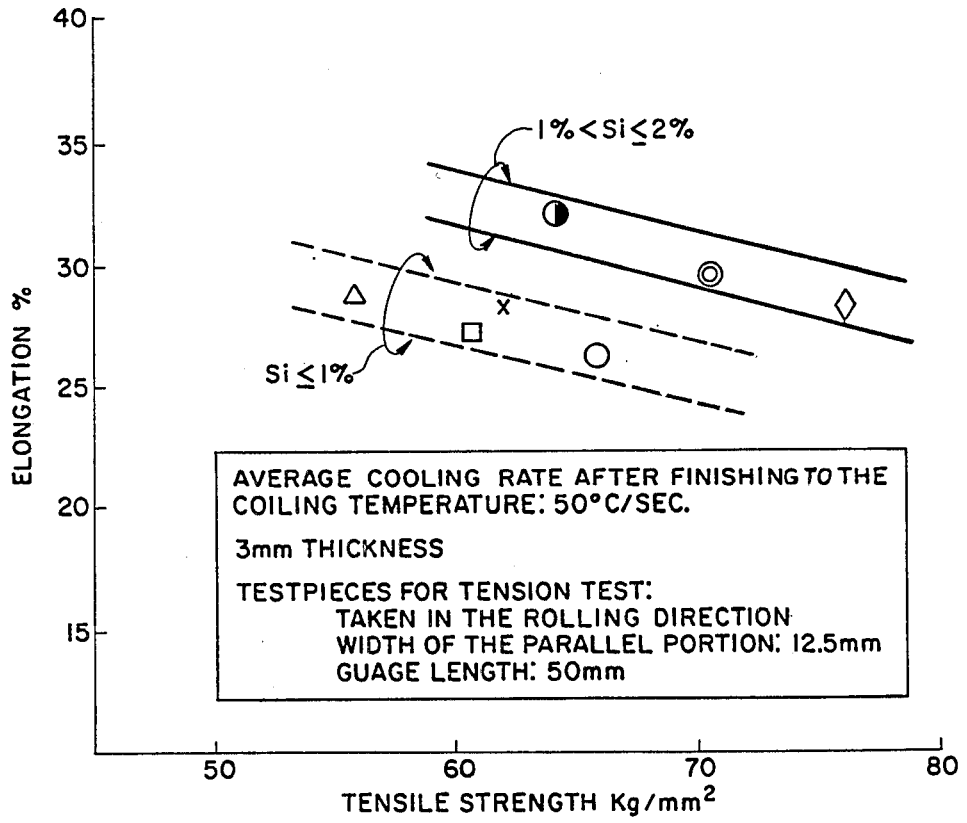
FIG. 2 is a graph showing the relation between the tensile strength and the elongation in various steel compositions.

The resultant ductility (elongation) level obtainable when the silicon content is more than 1%, is far better relative to the improvement of tensile strength than that obtainable when the silicon content is 1% or lower as shown in FIG. 2.

TABLE 2

| | C % | Si % | Mn % | P % | S % | Cr % | Al % | Finishing Tem. (°C.) | Coiling Tem. (°C.) |
|---|---|---|---|---|---|---|---|---|---|
| Δ | 0.060 | 0.02 | 1.41 | 0.005 | 0.006 | | 0.025 | 780 | 100 |
| □ | 0.062 | 0.02 | 1.42 | 0.006 | 0.006 | 0.11 | 0.028 | 780 | 100 |
| X | 0.051 | 0.74 | 1.28 | 0.012 | 0.004 | — | 0.020 | 810 | 100 |
| ○ | 0.065 | 0.01 | 1.39 | 0.007 | 0.005 | 0.30 | 0.035 | 775 | 100 |
| ◑ | 0.044 | 1.28 | 1.10 | 0.011 | 0.003 | 0.10 | 0.022 | 860 | 100 |
| ⊙ | 0.085 | 1.10 | 1.15 | 0.014 | 0.003 | — | 0.023 | 850 | 100 |
| ◊ | 0.080 | 1.79 | 1.25 | 0.008 | 0.004 | — | 0.030 | 860 | 100 |

| | Nominal Composition | | | | Nominal Composition | | |
|---|---|---|---|---|---|---|---|
| Δ | 0.06 C | 1.4 Mn | | ◑ | 0.04 C | 1.3 Si | 1.1 Mn |
| □ | 0.06 C | 1.4 Mn | 0.1 Cr | ⊙ | 0.09 C | 1.1 Si | 1.2 Mn |
| X | 0.05 C | 0.7 Si | 1.3 Mn | ◊ | 0.08 C | 1.8 Si | 1.3 Mn |
| ○ | 0.07 C | 1.4 Mn | 0.3 Cr | | | | |

As mentioned previously, increased silicon content to some extent will often cause increased difficulty in descaling problems after hot rolling, and deterioration of the paintability. However, for applications in which the ductility is of primary importance and the requirements for the steel surface quality are not that severe, such as, press-formed articles, including wheel discs, suspension arms, axle cases, and frame members of automobiles, steels having increased silicon contents can be very advantageously used. However, with silicon contents more than about 2%, the disadvantage in connection with the surface quality becomes larger and the desirable finishing temperature range must be considerably higher, so that it becomes practically very hard to coil the steel strip at the low temperature as defined in the present invention by the rapid cooling after the finishing rolling. Therefore, the upper limit of the silicon content is set at 2%.

Figure 3:
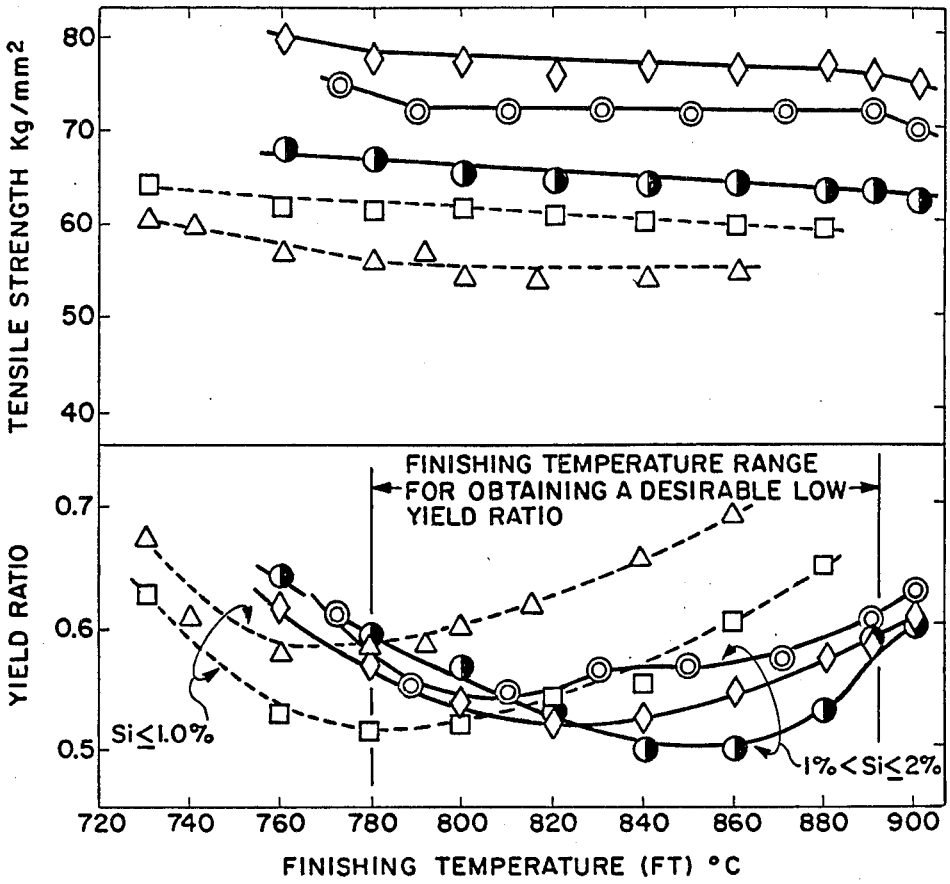
FIG. 3 is a graph showing the temperature ranges of finishing hot rolling for obtaining desirable low yield ratios in various steel compositions in correlation with the silicon contents and the variation in tensile strength with finishing temperature.

The finishing temperature of hot rolling is limited to a range of from 780° C. to 890° C. in order to obtain a satisfactory low yield ratio when the steel contains 1 to 2% Si as shown in FIG. 3. The steel compositions for FIG. 3 are indicated in Table 3.

TABLE 3

| | C % | Si % | Mn % | P % | S % | Cr % | Al % |
|---|---|---|---|---|---|---|---|
| Δ | 0.060 | 0.02 | 1.41 | 0.005 | 0.006 | — | 0.025 |
| □ | 0.062 | 0.02 | 1.42 | 0.006 | 0.006 | 0.11 | 0.028 |
| ◑ | 0.044 | 1.28 | 1.10 | 0.011 | 0.003 | 0.10 | 0.022 |
| ⊙ | 0.085 | 1.10 | 1.15 | 0.014 | 0.003 | — | 0.023 |
| ◊ | 0.080 | 1.79 | 1.25 | 0.008 | 0.004 | — | 0.030 |

| | Nominal Composition | | |
|---|---|---|---|
| Δ | 0.06 C | 1.4 Mn | |
| □ | 0.06 C | 1.4 Mn | 0.1 Cr |
| ◑ | 0.04 C | 1.3 Si | 1.1 Mn |
| ⊙ | 0.09 C | 1.1 Si | 1.2 Mn |
| ◊ | 0.08 C | 1.8 Si | 1.3 Mn |

As compared with the range of from 750° to 860° C. applicable to the steel containing not more than 1% Si, the finishing temperature range applicable to steel containing 1 to 2% Si is shifted slightly to a higher temperature range. In this connection, it is worthy to note that the addition of chromium is effective to satisfactorily lower the resultant yield ratio, rather than to enlarge the finishing temperature range.

The steel composition of the present invention, preferably is composed of from about 8 to 25% by volume of martensite plus retained austenite, i.e., 92 to 75 volume percent ferrite. Preferably, the low yield ratio of the steel composition as shown in FIGS. 1 and 3 is composed of a yield strength/tensile strength of from about 0.6 maximum. There is no limitation in the minimum value of the low yield ratio.

The composition of the present invention possesses a high strength which preferably is in the range of from about 50 kg/mm$^2$ to 80 kg/mm$^2$, as shown in FIGS. 1, 2 and 3. The ductility relates to the strength of the steel and is expressed in terms of tensile strength (kg/mm$^2$ × El%). The steel preferably has a ductility of no less than about 1620. Additionally, with respect to the artificial aging property, the present invention exhibits an increment in yield strength of preferably 6 kg/mm$^2$ or more and the variation in the increments along the length of the coil is preferably from about 6 to 9 kg/mm$^2$.

The following examples illustrate the present invention. Examples 1 and 2 relate to embodiments wherein the steel contains not more than 1% silicon, while Examples 3 and 4 relate to embodiments wherein the steel contains 1 to 2% silicon.

EXAMPLE 1

FIGS. 4*a*, 4*b*, 4*c* and 4*d* illustrate some examples of charts measuring the coiling temperatures of steel strips obtained by hot rolling a steel composition (within the scope of the present invention) containing 0.071% C, 0.01% Si, 1.15% Mn, 0.012% P, 0.04% S, 0.22% Cr and 0.32% Al (after rough rolling, finish rolling by seven passes into 2.5 mm thickness, and finishing at a temperature between 780° C. and 820° C.) followed by rapid cooling at an average cooling rate of 40° C./second and coiling. Below these charts, remarks have been made regarding the yield ratios and the artificial aging properties (yield-strength increments) after working (excluding the amount of work-hardening) at various portions of the coiled strips. The artificial aging property was determined by applying 3% tension, heating at 180° C. for 30 minutes, measuring the yield strength at room temperature, and calculating the difference between the yield strength and the 3% tension stress.

Figure 4:
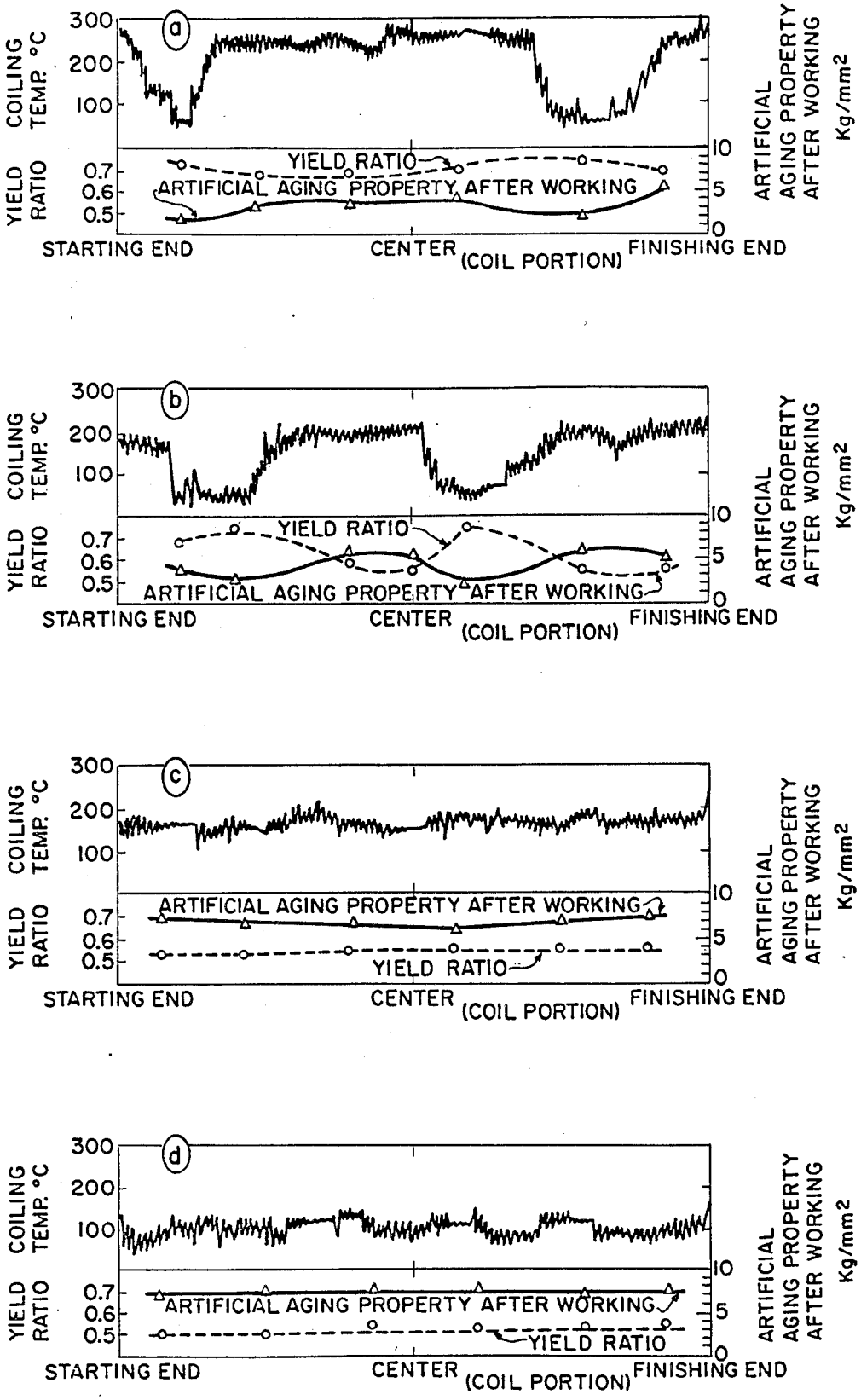
FIG. 4 *a, b, c* and *d* are graphs showing the coiling temperatures measured during the finishing hot rolling and coiling, the yield ratio and the artificial ageing property after working at various portions of a coiled strip.

In FIG. 4*a*, the coiling temperature includes the range beyond 230° C. which is the upper limit for the coiling temperature in the present invention, and the resultant yield ratio is high and the resultant artificial aging property after working is at a low level.

In FIG. 4*b*, the coiling temperature is not higher than 230° C., but considerable variation is seen in the resultant yield ratio and the artificial aging property after working, and therefore, the results are not satisfactory. In this case, the direction of the variation is completely contrary to that which would be expected by one skilled in this art. That is, the yield ratio and the artificial aging property after working at the portions coiled at lower coiling temperatures are rather inferior to these same properties at portions coiled at higher coiling temperatures. Based on the ordinary knowledge in the art, it would be assumed that a lower coiling temperature would cause more satisfactory martensite ($\alpha''$) formation, resulting in a more suitable two-phase structure, and a lowered yield ratio, and that a lower coiling temperature would improve the artificial aging property after working because the required and sufficient amount of solute carbon for the precipitation hardening could be more easily maintained in the ferrite ($\alpha$). However, the results shown in FIGS. 4*a* and 4*b* are contrary to these assumptions. The technical concept of adjusting the variation range of the coiling temperature is based on the consideration and study on the phenomena appearing in FIGS. 4*a* and 4*b*, which will be described in more detail hereinafter.

In FIG. 4*c*, the coiling temperature is about 180° C. with the variation in the coiling temperature being controlled so as not to exceed 100 deg.C. In FIG. 4*d*, the coiling temperature is maintained still lower. Both the resultant yield ratio and artificial aging property after working are consistent and satisfactory as shown in FIGS. 4*c* and 4*d*.

EXAMPLE 2

The unexpected results shown in FIGS. 4*a* and 4*b* will be described in connection with the following experimental data and studies set forth below.

Figure 5A:
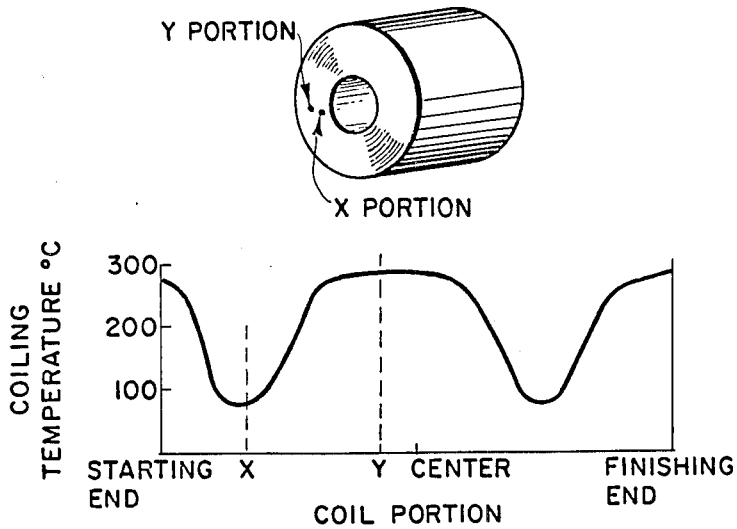
FIG. 5 *a* and *b* are graphs showing the distribution of coiling temperature and differences in the temperature history among various portions of a coiled strip.
Figure 5B:
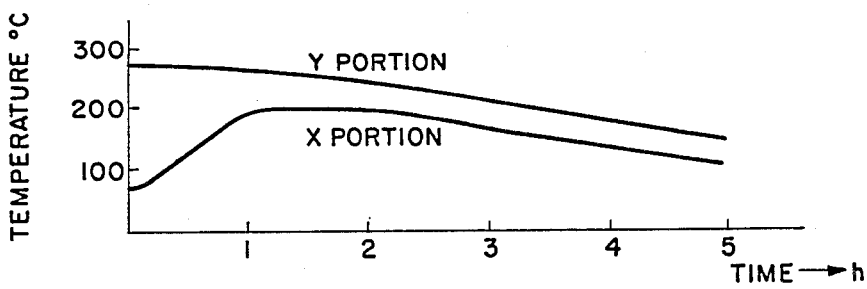
Figure 6:
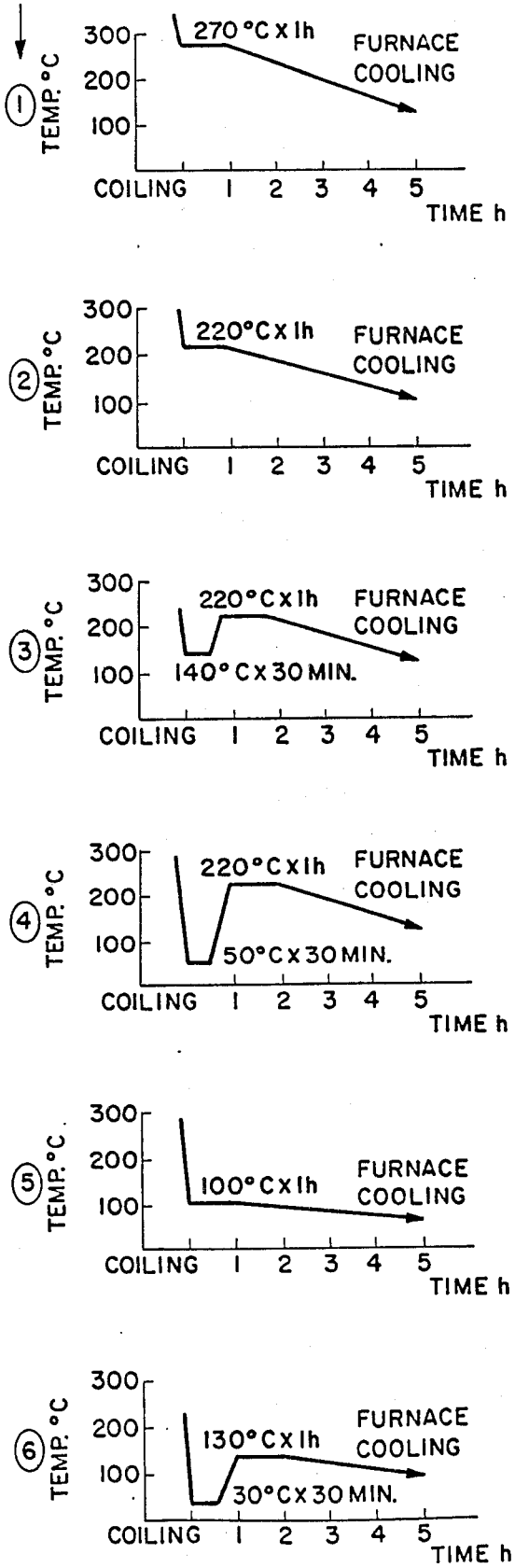
FIG. 6 is a series of graphs showing the conditions of several coiling simulation experiments, corresponding to different yield ratios and artificial ageing properties after working.

When a steel strip having the distribution of coiling temperatures as shown in FIG. 5*a* is coiled, the low temperature portion X and the high temperature portion Y are coiled in closely contacting layers, so that the X portion and the Y portion of the coiled strip will have a heat history as shown in FIG. 5*b*. Thus, the low temperature portion X is significantly reheated by the heat transfer from the high temperature portion Y. The effect of these heat histories on the yield ratio and the artificial aging property after working (determined as mentioned hereinbefore) were studied on a laboratory scale using a sample steel containing 0.064% C., 0.78% Si, 1.25% Mn, 0.011% P, 0.005% S and 0.031% Al, a composition within the scope of the present invention. The steel was heated at 1100° C. and hot rolled with three passes into 2.5 mm thickness with a finishing temperature at 820° C., then cooled at an average rate of 50° C./second and charged into a furnace maintained at various coiling temperatures and furnace cooled. In some instances samples were reheated before the final furnace cooling, as shown in FIG. 6. The results are shown in FIG. 6.

Under simulated coiling condition 4, in which a portion coiled at a lower temperature (50° C.) was assumed to be reheated by a temperature increment of 170 deg. C. (reheated to 220° C.), the desired low yield ratio cannot be achieved and the artificial aging property after working is also inferior. In contrast, under simulated coiling conditions, 2, 3, 5 and 6, similar and satisfactory results are obtained. Simulated coiling condition 6, for example, represents the limiting thermal history of a portion coiled at 30° C. if the coiling temperature varies in the range of from 30° to 130° C. along the coil length (in practice, the highest temperature portion gradually loses its temperature after coiling so that the lowest temperature portion would not be reheated to undergo such a "limiting thermal history"). In other words, the 30° C. portion would be reheated to a temperature fairly lower than 130° C.

The satisfactory results obtained under condition 6 shows that coiling temperature variations within 100 deg. C. are not harmful in obtaining a low yield ratio and a satisfactory artificial aging property after working. The same holds true for coiling condition 3.

Meanwhile, under simulated coiling condition 4, in which the coiling temperature varies from 50° C. to 220° C., the limiting thermal history due to heat recovery for the lowest temperature portion is shown. In spite of the sufficiently low average coiling temperature, which should be lower than that under coiling condition 3, the resultant properties are inferior. This indicates that if the coiling temperature varies with a temperature difference as large as 170 deg. C., considerably deterioration of the properties is caused even though the overall coiling temperature is sufficiently low.

Under coiling condition 1, the resultant yield ratio is high and the artificial aging property after working becomes inferior. This fact indicates that a coiling temperature of 270° C. is excessively high even though the coiling is done without any temperature variations.

EXAMPLE 3

A steel composition containing 0.085% C, 1.10% Si, 1.15% Mn, 0.014% P, 0.003% S and 0.023% Al (within the scope of the present invention) is subjected to a finishing hot rolling on an actual hot rolling line (after rough rolling and finishing with seven passes into a 2.5 mm thickness at a finishing temperature ranging from 800° C. to 840° C.) rapidly cooled at an average cooling rate of 40° C./second, coiled at various temperatures, and cooled to room temperature. Tensile test pieces are taken from various portions of the coil to determine the yield ratio and the artificial aging property (determined by the same method described hereinabove).

Representative examples of the results are shown in Table 4.

TABLE 4

| Coil No. | Variation Range of Coiling Temperatures max. °C. | min. °C. | Yield Ratio | Artificial Aging Property After Working Kg/mm² | Coiling Temp. at Portions where the Yield Ratio and the Artificial Aging Property are Measured (from the Temp. Measurement Chart) °C. |
|---|---|---|---|---|---|
| 1 | 290 | 170 | 0.75 | 3.9 | 280 |
| | | | 0.79 | 2.8 | 170 |
| | | | 0.73 | 3.8 | 290 |
| 2 | 220 | 40 | 0.63 | 5.1 | 220 |
| | | | 0.75 | 2.9 | 50 |
| | | | 0.61 | 5.1 | 210 |
| 3 | 220 | 130 | 0.54 | 8.3 | 210 |
| | | | 0.55 | 8.2 | 130 |
| | | | 0.54 | 8.5 | 220 |
| 4 | 150 | 50 | 0.52 | 8.8 | 140 |
| | | | 0.52 | 8.9 | 50 |
| | | | 0.53 | 9.1 | 130 |

As shown above, almost the same results as in Example 1 are obtained.

EXAMPLE 4

Test pieces having a composition of 0.055% C, 1.69% Si, 1.28% Mn, 0.010% P, 0.005% S, 0.12% Cr and 0.025% Al were subjected to the same conditions and treatment as in Example 2 except that the finishing temperature was 850° C. The results are shown in FIG. 6 and the same tendencies as in Example 2 were observed.

In view of the results obtained by the foregoing Examples, the coiling conditions are limited in the present invention as described hereinbefore.

The following discussion relates to the metallurgical phenomena involved in the coiling step.

If the coiling temperature (CT) is excessively high, it is impossible to effect the martensite ($\alpha'$) transformation during the subsequent slow cooling because the austenite ($\gamma$) phase transforms into bainite so that it is impossible to lower the yield ratio by formation of a two-phase structure (for example, the coiling condition 1 in FIG. 6).

In a case where the coiling temperature is within a range which causes transformation of the austenite ($\gamma$) phase into the martensite rather than transformation into the bainite, the following observations may be made.

Figure 7:
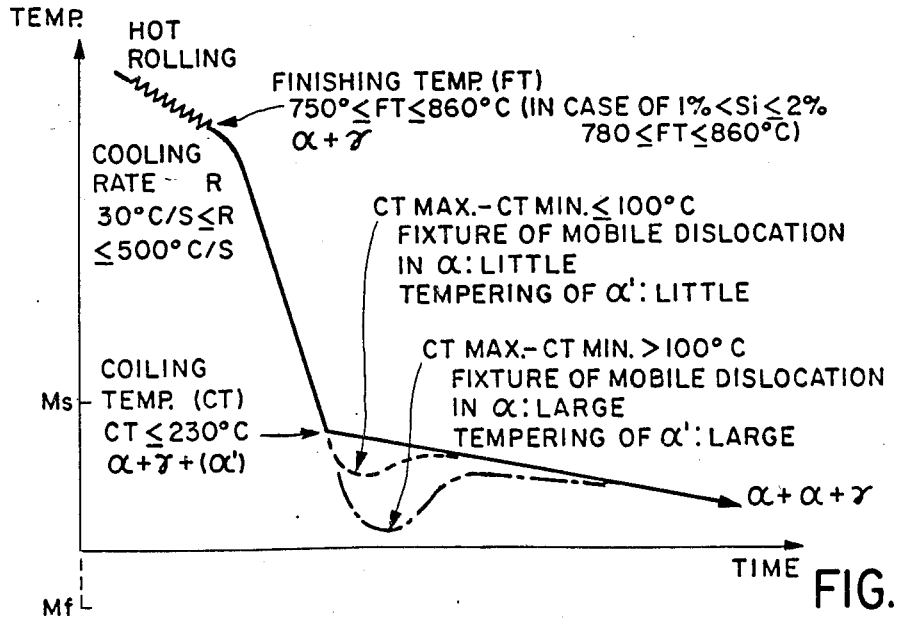
FIG. 7 is an explanatory graph showing the changes in the steel structure which took place during the finishing hot rolling, the cooling, the coiling and the slow cooling steps.

In a two-phase steel sheet which has been coiled and slowly cooled to room temperature (RT), a small amount of retained austenite is always observed together with the ferrite ($\alpha$) and the martensite ($\alpha'$). Therefore, as shown in FIG. 7, at the time when the steel strip has reached the coiling temperature (CT) after finishing hot rolling with a finishing temperature (FT) and cooling, the structure of the steel strip is considered to be composed of $\gamma$ phase, $\alpha$ phase, and possibly a small amount of $\alpha'$ phase. Thus, Ms and Mf (the martensitic transformation starting and finishing temperatures, respectively, of the $\gamma$ phase existing in the course of cooling to the coiling temperature) are considered to be arranged in the following order $$Ms > CT(\text{e.g. } 230^\circ \text{ C.}) > RT > Mf$$

Now when the $\gamma$ phase is rapidly cooled to a temperature T as defined by $Ms > T > Mf$, the $\gamma$ phase transforms into $\alpha'$ with a fraction f(T) determined by T. The fraction f(T) increases as T lowers within the above range (c.f. W. Hume-Rothery, The Structure of Alloys of Iron; An Elementary Introduction, 1966, Pergamon Press, England). Thus f(T) can vary almost from 0% to almost 100% in correspondence to the temperature T.

Meanwhile, the reason why a two-phase steel has a low yield ratio may be attributed to the fact that the $\alpha$ phase surrounding the marteniste ($\alpha'$) is subjected to an elastic strain due to the strain of martensitic transformation of the $\gamma$ phase, and that many mobile dislocations are generated in the $\alpha$ phase near the boundary between the $\alpha$ phase and the $\alpha'$ phase, due also to the martensitic transformation strain (Morikawa et al. "Tetsu to Hagane" Vol. 64 1978), No. 11, S. 740).

If a portion of a two-phase steel strip is coiled at a considerably low coiling temperature (CT) where the martensite ($\alpha'$) is formed with a considerably large f(T), and then reheated to a sufficiently high temperature by the heat transfer from a higher-temperature-coiled portion in the coiled state (e.g. the coiling condition 4 in FIG. 6), the above mentioned mobile dislocations in the $\alpha$ phase are fixed by the solute carbon atoms. Also, the $\alpha'$ phase is tempered to some degree and tends to decompose into the $\alpha$ phase and carbide precipitates so that the elastic strain as mentioned above is relieved. This increases the yield strength and results in loss of the low yield ratio property inherent in a two-phase steel. At the same time, the solute carbon atoms which should be effective to fix the dislocations during an artificial aging after working are consumed by said fixing of the mobile dislocations at the time of heat recovery in the coiled state. Consequently, the artificial aging property after working in poor.

When the coiling temperature (CT) is not so low, and hence the martensite ($\alpha'$) is formed with a relatively small f(T), both the amounts of the solute carbon atoms and martensite ($\alpha'$) which are nullified by the heat recovery in a coiled state for the reason set forth above, are small. Thus, the adverse effects of heat recovery as described above are naturally reduced, unless the reheated temperature is so high as to cause bainitic and/or pearlitic transformations from the $\gamma$ phase (e.g. the coiling condition 3 in FIG. 6).

If the steel strip is gradually cooled without the heat recovery in a coiled state, the fraction f(T) increases as the temperature T lowers as described before, and thus the mobile dislocations are generated in the ferrite ($\alpha$). The temperatures for a main portion of f(T) would be too low to cause a rapid precipitation of solute carbon onto the mobile dislocations. This allows the mobile dislocations to remain unfixed (e.g. the coiling condition 2 in FIG. 6), so substantially no adverse effects are produced. When the coiling temperature (CT) is considerably low and the martensite ($\alpha'$) is formed with a large f(T) without any heat recovery in a coiled state (e.g. the coiling condition 5 in FIG. 6) no problems result. Similarly, problems do not arise when the temperature of the strip is increased by the heat recovery in a coiled state to such a low level as to prohibit a rapid fixture of the mobile dislocations by the solute carbon (e.g. the coiling condition 6 in FIG. 6).

From the above observations and experimental data, it can be concluded that for improving the artificial aging property after working, it is very important to control the variation in the coiling temperature during the period between the start of coiling and the completion of coiling as clearly illustrated by the foregoing examples.

Some additional considerations as set forth below should be made in the practice of the present invention.

With the present invention, as the finishing temperature is lower than that in ordinary hot rolling, there is a tendency that the worked structure from the finishing rolling may remain in the proeutectoid $\alpha$ phase. However, this worked structure can be fully recovered if the strip is left for 1 to 2 seconds before the cooling so that there is no fear about adverse effect on the ductility. This requirement is easily fulfilled by an ordinary hot strip mill.

The limitation of the coiling temperature is a very important feature of the present invention. However, in actual practice, the operation could be easier if the very beginning and/or the very ending of the coiling are maintained at a slightly higher temperature than the defined coiling temperature range. Inasmuch as both ends of the coiled strip are cooled more rapidly than the other portions, there is no practical problem so long as about 5% of the whole length of the coiled strip at both ends is coiled at a temperature slightly higher than the defined coiling temperature.

Further, within the scope of the present invention, one or more rare earth elements (REM) or Ca and the like may be added to the steel composition for the purposes of controlling the shape of non-metallic inclusions and further improving the stretch-flange formability. It is recommended that these elements be added in amounts such as REM/S $<5$ and Ca/S $<3$ as calculated by percent by weight depending on the content of sulfur impurity.

Further, within the scope of the present invention, one or more of Nb, V, Ti and W, each in an amount not larger than 0.2%, and Mo, in an amount not larger than 0.5%, may be added to the steel composition for the purpose of preventing the softening of metal around welded portions as seen when the steel is subjected to spot welding, flash-butt welding, arc welding and the like.

What is claimed is:

1. A process for producing a low yield ratio, high strength two-phase steel sheet having an excellent artificial aging property after working, comprising:

hot rolling a steel composition containing 0.03 to 0.13% C, 0.8 to 1.7% Mn, from between 1.0% to 2.0% Si, not more than about 0.1% Al, with the balance being Fe and unavoidable impurities, with a finishing temperature ranging from 750° C. to 860° C.;

rapidly cooling the hot rolled steel to a temperature not higher than 230° C. within a temperature variation within a range of not more than 100° C., at an average cooling rate ranging from 30° C./second to not more than 500° C./second; and coiling the strip thus cooled to produce a steel having an artificial aging property after working (increment yield strength) of no less than 6 kg/mm$^2$.

2. The process of claim 1, wherein the steel composition further contains Cr in an amount not larger than 0.5% Cr.

3. The process of claim 1 wherein the steel composition further contains Ca, REM or combinations thereof in amounts of Ca%/S% $<3$ and REM%/S% $<5$.

4. The process of claim 1 wherein the steel composition further contains Cr in an amount not larger than 0.5% Cr, and at least one element selected from the group consisting of Ca and REM in amounts as defined by Ca%/S% $<3$ and REM%/S% $<5$.

5. The process of claim 1 wherein the steel composition further contains at least one element selected from the group consisting of Nb, V, Ti, W, each in an amount not larger than 0.2%, and Mo in an amount not larger than 0.5%.

6. The process of claim 1 wherein the steel composition further contains at least one element selected from the group consisting of Nb, V, Ti, W, each in an amount not larger than 0.2%, and Mo in an amount not larger than 0.5%.

7. The process of claim 3 wherein the steel composition further contains at least one element selected from the group consisting of Nb, V, Ti, W, each in an amount not larger than 0.2% and Mo in an amount not larger than 0.5%.

8. The process of claim 4 wherein the steel composition further contains at least one element selected from the group consisting of Nb, V, Ti, W, each in an amount not larger than 0.2% and Mo in an amount not larger than 0.5%.

9. A process for producing a low yield ratio, high strength, two-phase steel sheet having an excellent artificial aging property after working comprising:

hot rolling a steel composition containing 0.03 to 0.13%C, 0.8 to 1.7% Mn, not more than 0.1% Al and 1 to 2.0% Si, with the balance being Fe and unavoidable impurities with a finishing temperature ranging from 780° to 890° C.;

rapidly cooling the hot rolled steel to a temperature not higher than 230° C. at an average cooling rate ranging from 30° C./second to not larger than 500° C./second; and coiling the strip thus cooled at a temperature not higher than 230° C. with a temperature variation during a period from the start to the end of the coiling being controlled within a range of not more than about 100 degrees C.

10. The process of claim 9 wherein the steel composition further contains not more than 0.5% Cr.

11. The process of claim 9 wherein the steel composition further contains at least one element selected from the group consisting of Ca and REM in amounts defined by Ca%/S% $<3$ and REM%/S% $<5$.

12. The process of claim 10 wherein the steel composition further contains at least one element selected from the group consisting of Ca and REM in amounts defined by Ca%/S% <3 and REM%/S% <5.

13. The process of claim 9 wherein the steel composition further contains at least one element selected from the group consisting of Nb, V, Ti, W, each in an amount not larger than 0.2% and Mo in an amount not larger than 0.5%.

14. The process of claim 10 wherein the steel composition further contains at least one element selected from the group consisting of Nb, V, Ti, W, each in an amount not larger than 0.2% and Mo in an amount not larger than 0.5%.

15. The process of claim 11 wherein the steel composition further contains at least one element selected from the group consisting of Nb, V, Ti, W, each in an amount not larger than 0.2% and Mo in an amount not larger than 0.5%.

16. The process of claim 12 wherein the steel composition further contains at least one element selected from the group consisting of Nb, V, Ti, W, each in an amount not larger than 0.2% and Mo in an amount not larger than 0.5%.

* * * * *